United States Patent [19]

Wells

[11] 4,249,992

[45] Feb. 10, 1981

[54] STEAM SHOWER FOR ADJUSTING PAPER MOISTURE PROFILE

[75] Inventor: Roger Wells, Mercer Island, Wash.

[73] Assignee: Weyerhaeuser Company, Tacoma, Wash.

[21] Appl. No.: 964,322

[22] Filed: Nov. 29, 1978

[51] Int. Cl.[3] ..... D21F 1/80; D21F 5/14; D21F 5/18

[52] U.S. Cl. ..... 162/198; 34/34; 34/54; 34/155; 162/207; 162/252; 162/DIG. 6

[58] Field of Search ..... 162/290, 207, 252, 198, 162/DIG. 6; 34/34, 54, 23, 155

[56] References Cited

U.S. PATENT DOCUMENTS

| | | | |
|---|---|---|---|
| 3,089,252 | 5/1963 | Daane et al. | 34/34 X |
| 4,124,941 | 11/1978 | Birke et al. | 34/34 |

OTHER PUBLICATIONS

Chari et al., "Profile Analysis for Evaluation of a Compartmentized Steam Box" Tappi Annual Meeting Preprint, N.Y., Mar. 15-17, 1976.

*Primary Examiner*—S. Leon Bashore
*Assistant Examiner*—Steve Alvo

[57] ABSTRACT

A steam shower for reducing paper web moisture content variability in the cross machine direction is described. The local dewatering effect of the shower on the moving supported web is controlled by varying its bottom steam discharge area incrementally across the width of the web. In one embodiment the hood is divided across the width of the machine into compartments, each having at least one cross machine direction wall whose bottom edge may be adjusted relative to the rear wall of the hood. A second embodiment has a pleated curtain whose bottom edge is controlled by lever arms with respect to the hood's rear wall. Local adjustments are made based on a comparison of moisture measurements at the finished product reel with the desired level.

3 Claims, 4 Drawing Figures

STEAM SHOWER FOR ADJUSTING PAPER MOISTURE PROFILE

BACKGROUND OF THE INVENTION

1. Field of the Invention

The invention relates to papermaking wherein suction dewatering of the wet, fibrous web on the forming wire is improved by showering the web with steam as the supported web is subjected to a vacuum. More particularly the improvements relate to steam showers which effect variations of web moisture content across the width of the sheet.

2. Description of the Prior Art

It is well known in the art of papermaking to employ steam showers to improve suction dewatering of pulp and paper webs at various locations on the paper machine. Such showers are especially useful at the "wet end" or forming sections of the paper machine where the webs typically exceed 50 percent moisture content by weight.

A typical shower impinges dry, saturated or superheated, steam onto the travelling web. The web, supported on a forming wire or drying belt, is simultaneously subjected to a vacuum. The vacuum pulls the steam into the sheet interior where it condenses, giving up its heat of condensation. The heat is absorbed by the water content of the web.

It is known that the moisture removal rate from the web, when subjected to a vacuum, is proportional to the square root of the ratio of surface tension to viscosity. Both surface tension and viscosity are directly proportional to temperature. Therefore, increasing moisture removal rate is a linear function of increasing sheet temperature. Hodges, "Optimum Use of Steam Shower for the Paper Machine," TAPPI Vol. 60, No. 7 (July 1977).

The increase in temperature caused by the steam shower dramatically lowers the viscosity and surface tension of the water content of the web, resulting in a more thorough extraction of water for a given vacuum volumetric rate. The use of a steam hood generally decreases the overall moisture level of the web, across its entire width.

It is the experience of papermakers, however, that significant moisture content non-uniformity across the width of the web may occur which adversely affects paper machine operation. For example on most machines the edges of the web tend to become dryer than the web's center portion. The normal variation in moisture profile may be 3–4 percent; for example, varying from 3 percent moisture at the edges to 7 percent moisture content at the center of the web.

It is further the experience of papermakers that various defects in machinery or in its operation result in "wet streaks" or areas that have relatively high moisture content with respect to surrounding web areas. Many wet streaks originate, for example, in the press section when portions of the press felts become plugged because of faulty shower systems. These streaks generally appear at unpredictable locations across the width of the web. Wet streaks can run for days before the source of difficulty is found.

The degree of uniformity of moisture content of the web, across the machine width, as the web leaves the forming section determines to a large extent the average moisture level that can be maintained in finished paper at the reel. This is so because conventional pressing and can drying are not generally designed to correct local web nonuniformity across the paper machine width.

The speed of the entire machine may be determined by the maximum wetness at the reel, even if the wet streak is only two inches wide. Compensation for one or two regions of wet streaking will necessitate a reduction in overall water content by several percent in order to build an acceptable reel. This has an important effect on machine speed and steam consumption and thus has an impact on the profitability of the operation.

The prior art describes several schemes for attempting to control the sheet moisture profile in the cross machine direction. Compartmentalized steam hoods, for example, shower a wet streak with extra steam in an effort to reduce variability and the potential for rejection at the reel for failure to meet maximum water content specifications.

Dupasquier, in U.S. Pat. Nos. 3,726,757 and 3,795,578 describes a steam shower divided into 11 compartments across the width of the paper machine, each equipped with a separate steam flow valve. A vacuum box, opposite the shower and under the machine wire, draws steam into the web across the entire width of the machine. Chari et al, "Profile Analysis for Evaluation of a Compartmentalized Steam Box," TAPPI Annual Meeting Preprint (Mar. 15, 1976) describes operation of the Dupasquier hood. The object of the hood is to improve the basis weight and moisture profile by individually controlling steam flow to each compartment. The Chari experiment showed that the profiling steam hood is effective in reducing long-term, cross machine moisture profile variation. The Dupasquier hood resulted in a total reduction of variance of moisture content of approximately 40 percent from a base line value without any significant change in bone dry fiber profiles.

A major disadvantage of the known compartmented steam hoods becomes evident when the steam flow to individual compartments is reduced below the fixed local volumetric rate of the vacuum system. When this occurs, the vacuum system will tend to make up flow from adjacent compartments that have higher steam flow rates. The vacuum flow might be made up from air outside the hood, but this is less likely because the geometry of the bottom discharge favors robbing adjacent compartments. This is so because compartments generally have much greater adjacent side dimensions than end walls widths under which outside air might be drawn into the hood. The tendency of a vacuum system to even up the flow of steam onto the web across the width of the web works against the moisture uniformity goal and reduces the sharpness of control possible.

Speidel, in U.s. Pat. No. 3,945,881, describes a compartmented steam shower that attempts to cope with this problem. In Speidel, the opposing suction box drawing steam into the web, is compartmented similar to the steam hood portion. During local reduction of steam flow onto the sheet, adjacent local vacuum volumetric rate is also decreased. Thus, this apparatus reduces the possibility of one compartment robbing adjacent compartments at the cost of doubling the controlling system.

Another disadvantage of the compartmented steam hoods is that the amount of steam condensed in the web is largely dependent upon the porosity of the sheet and the capacity of vacuum available. If the steam flow is increased to a point where either of these limitations is exceeded, excess steam will blow out into the machine room. This problem becomes evident when the known compartmented hoods attempt to cope with wet streaks.

It is the object of the present invention to provide a method and apparatus for improving the uniformity of paper web moisture profiles across the width of the web.

An aim of the profiling steam hoods of this invention is to remove objectionable wet streaks in the sheet by applying greater amounts of steam over larger surface areas to those areas, thereby avoiding the porosity and vacuum capacity limitations known in the art. In this regard, increased condensation of steam in the web is achieved by increasing the contact area between the web and the steam flow. Thus, absorption can be improved without relying on the limited ability of the vacuum system to draw greater rates of steam through the web.

An object of the present invention is to provide a compartmented steam shower hood that avoids the prior art problem of the vacuum system tending to cause decreased profiling control by robbing adjacent high steam flow compartments to make up for low flow areas. Design criteria of the present invention insures that there are supplemental air flows to the fixed vacuum system when steam flows to particular compartments are reduced. Thus, a sharper controlled response to wet streaks is possible.

The profile improvement permits a higher average moisture level at the reel with reduced fear of off-specification paper. For dryer limited operations, productivity is increased. Product quality, in terms of the uniformity, is improved and energy consumption reduced.

BRIEF SUMMARY OF THE INVENTION

In brief summary, the invention is a method and apparatus for improving the uniformity of the moisture profile of a finished pulp or paper web, measured across its width, as it leaves the continuous paper making machine.

The method requires regulating a flow of steam from a steam hood onto the wire-supported wet fibrous web as it passes over a constant volume vacuum box, preferably in the forming section of a pulp web or paper making machine, incrementally across the width of the wire in the machine cross direction (CD), in response to incremental measurements of moisture content, preferably made at the finished product reel. The amount of steam absorbed by the web is regulated by adjusting the surface area of a blanket of steam that contacts the moving web at an instantaneous location. The temperature of the web increases in proportion to the instantaneous area of web contacted by the steam. The resulting temperature, in its effect upon the viscosity and surface tension of the web's water content, determines how much water will be removed by a given vacuum source. In this manner wet streaks, characteristic of a particular paper machine, may be removed. The moisture profile of the web at the reel will generally be identical to the geometry of the opening of the hood discharge bottom, given a web having an otherwise level moisture profile.

The basic approach requires providing a blanket of substantially zero velocity, atmospheric pressure steam in contact with the travelling web as it passes over a vacuum box; sensing the moisture content of the finished web after conventional drying, at intervals across the width of the web; and adjusting the dimensions of the steam blanket in the machine direction (MD), in response to the sensor measurement at each interval. These steps are repeated until the desired level of moisture content uniformity is achieved. After the profile has been stabilized, the area of the web exposed to steam may be reduced further overall since there is less danger of producing paper that is too wet due to minor machine variations.

The novel apparatus for accomplishing the improved moisture profile uniformity comprises means for varying the bottom steam discharge area of a steam hood or shower, incrementally across the width of the web. The apparatus comprises, in general: a steam hood, suspended just above the surface of the moving wire-supported web as it passes over a suction box, extending substantially perpendicular to and across the width of the web; a steam distributor means for providing steam to the hood across the width of the web; an upper hood zone, permitting the free flow of steam in the cross machine direction so that the steam supply in the hood remains substantially independent of variations across the width of the web and the rate of discharge of steam from the bottom of hood; a lower hood zone, including a plurality of means for controlling the discharge area of the bottom of the hood incrementally across the width of the hood, thereby controlling the flow rate of steam from the hood onto the web at each control means. The outer hood structure is open to allow free air passage when the steam discharge area is reduced locally below the adjacent vacuum volumetric rate. This permits the vacuum box to pull air from the machine room rather than rob steam from adjacent compartments having a higher steam flow.

In one embodiment, the upper hood zone comprises a plenum containing a steam delivery pipe extending in the CD. The steam discharges into the lower hond zone. The lower hood zone is divided into incremental open top and bottom compartments across the width of the wire-supported web. Each compartment is provided with at least one wall in the cross machine (CD) direction arranged so that the bottom edge of wall is adjustable in position with respect to the bottom edge of the opposite CD wall of the compartment. This wall is adjusted through appropriate controls or lever arms, resulting in variation of the compartment steam discharge opening. A single movable wall may be provided or both CD walls may be adjustable. A compartment width of 1–20 inches (0.16–0.50 m) appears to be satisfactory.

In another embodiment of the invention the hood is not compartmented and the lower and upper hood zones are combined. The variable area bottom discharge hood means, comprises: at least one flexible wall, extending across the hood in the cross machine direction and vertically from the bottom of the upper hood zone to just above the moving web. A plurality of controllers operate at the bottom edge of the curtain to move the upstream curtain in the machine direction relative to the fixed downstream curtain.

BRIEF DESCRIPTION OF THE DRAWINGS OF THE PREFERRED EMBODIMENTS

DETAILED DESCRIPTION OF THE PREFERRED EMBODIMENTS

Figure 1:
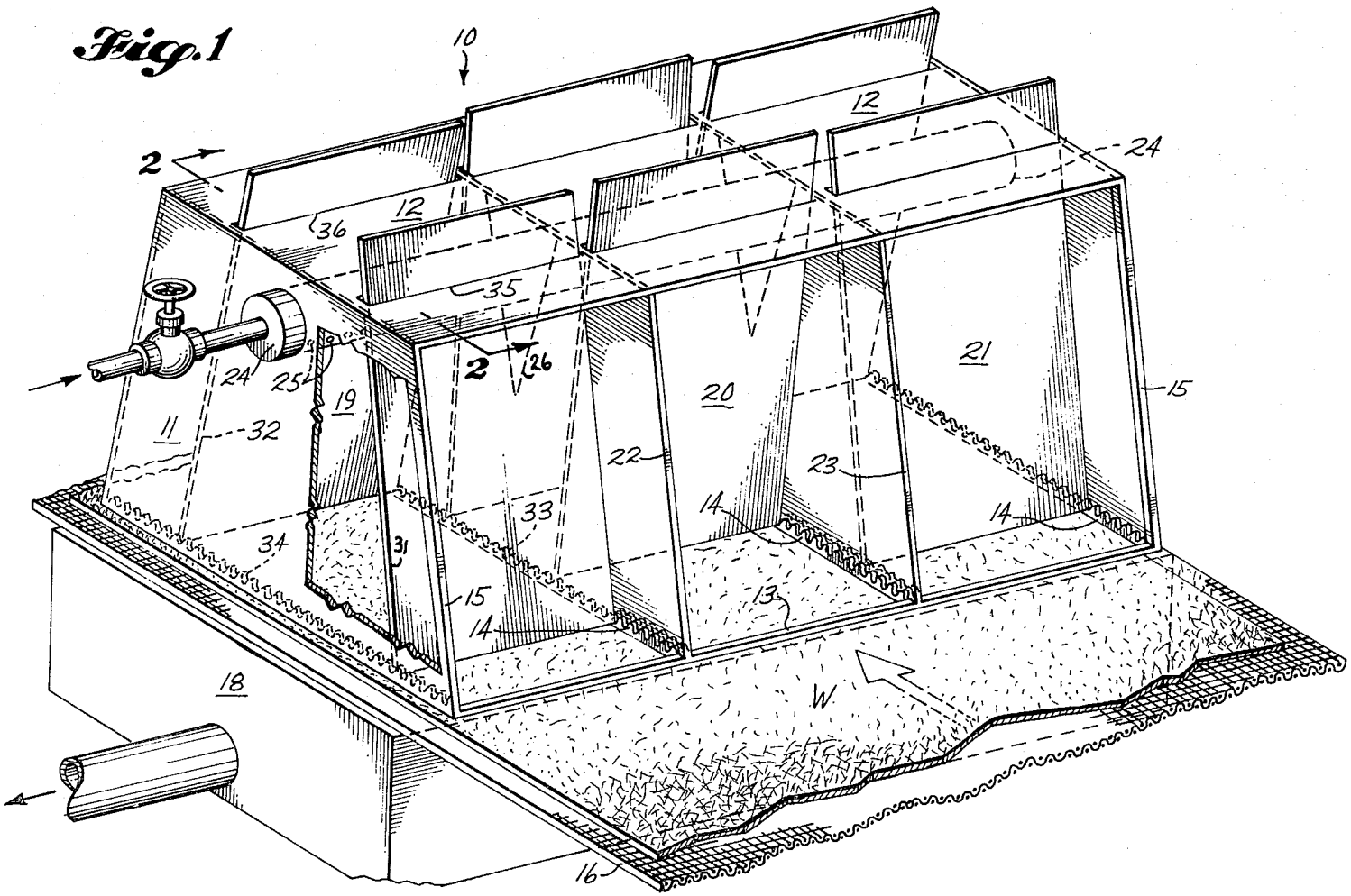
FIG. 1 is an oblique view of the profiling steam hood divided into compartments, each having a variable steam discharge opening.
Figure 2:
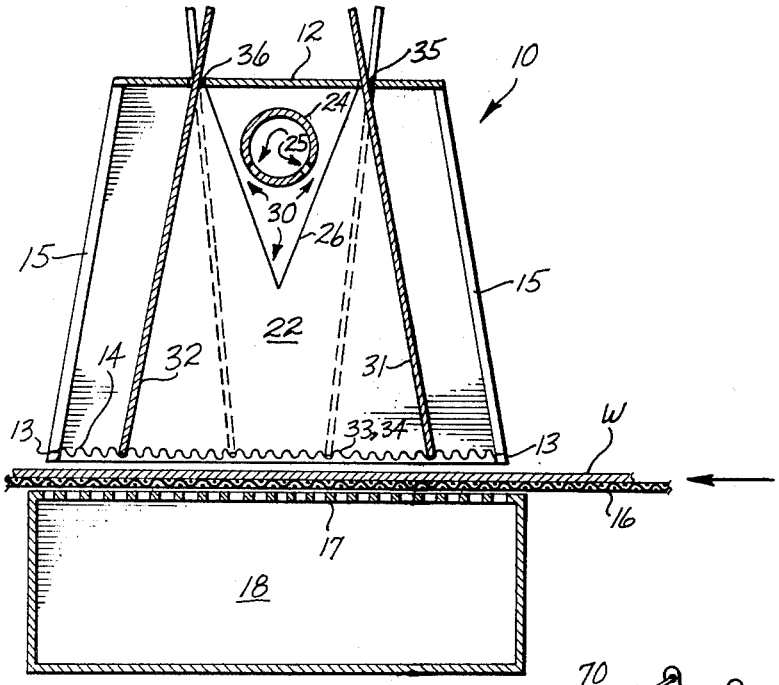
FIG. 2 is an end section of the embodiment shown in FIG. 1.

A preferred embodiment of the invention, capable of applying steam to a fibrous web at rates that vary in the cross machine direction (CD) is shown in FIG. 1–2. It is to be understood that the steam hood or shower system of this invention, generally, as known in the art, impinges steam onto the fibrous web of pulp or paper that is supported on a travelling wire or felt. The shower operates in conjunction with a suction box, across which the web-supporting wire slides, that draws steam into the web. The suction box is co-extensive with the shower, in the cross machine direction (CD) and is as wide as the hood. The hood or shower means may be positioned in the pulp web or paper-making process on any supported run of the web, after forming, before the web enters the drying section of the machine. The hood system is preferably positioned at the forming wire, just after web formation has been stabilized and the moisture content of the web is about 50 percent by weight. Neither the paper machine layout nor detail of the suction box is shown in the drawings, since both are well known.

Referring to FIGS. 1 and 2, the hood 10 comprises a box-like structure having enclosing sidewalls 11, top 12, and strengthening supporting members 13, 14 and 15 extending in the length, width and height of the hood 10, respectively.

The bottom edge of the hood (members 13, 14) is located as close as practical to the sheet W, supported on travelling wire 16. A clearance of about 1 inch is typical. The hood extends in the CD sufficiently to effectively apply steam to the entire width of the paper sheet W. The wire 16 slides across the suction surface 17 of the suction box 18.

The hood is divided into compartments 19, 20, 21 in the CD by divider walls 22, 23. An optimum steam compartment box CD width is 6–7 inches, the width of the head box slice. In most cases, wet streaks are somewhat wider.

A steam distributor 24 extends the entire length of the hood. The distributor 24 may be steel pipe, 6–8 inches in diameter, with two rows of apertures 25 along its length, each row cut at 20–40 degrees from the horizontal. The apertures 25 are of such diameter that "choked flow" of steam from the distributor results. Choked flow means that the steam delivery rate from the distributor is uniform regardless of minor steam pressure variations locally along the length of the distributor. The steam, after discharge, is superheated, at substantially atmospheric pressure to eliminate condensation problems.

Each compartment divider wall 22, 23 is provided with slots or an aperture 26 to allow steam to flow freely throughout the upper hood zone 30 in the CD direction.

The CD walls 31, 32 of each compartment (numbered in the first compartment 19 only) are substantially rectangular. The bottom edge of each CD wall 31, 32 rests in a serrated track 33, 34 mounted on MD members 14. The bottom edges of the walls 31, 32 are adjustable, with respect to each other, in machine direction. The tracks 33, 34 help secure the walls in position during operation of the hood. The upper portion of each CD will pivots about a CD axis, here consisting of slots 35, 36 cut into the top 12 of the hood.

In operation, the upper hood zone 30, comprising the hood portion bounded by the top 12, end wall 11, CD walls 31, 32 and extending downwardly to about the bottom of the steam passage slots 26, is flooded with substantially zero velocity dry steam at atmospheric pressure.

The bottom edges of the CD walls 31, 32, comprising, in effect, the steam discharge controlling means, are spaced apart relative to one another, in the machine direction. The initial nominal spacing for each compartment is selected by the operator, based upon his experience with the characteristics of a particular paper machine.

The vacuum box 18 opposite the hood draws the steam into the sheet and extracts a portion of its water load. The steam condenses giving up its heat of condensation which increases the temperature of the water content of the web, thereby improving dewatering rate. After the system has stabilized, the moisture content of the web across its width is measured at the reel (after conventional drying) and compared with the desired target level. Each compartment gate is then adjusted to either provide greater or lesser opening area if the reading is above or below, respectively, the level of moisture content desired.

When a discharge opening is reduced relative to an adjacent compartment, the suction box pulls steam into the web, below the open hood discharge area. Air is drawn from the machine room outside the hood adjacent the shutoff discharge area. Since each compartment is supplied from the upper hood zone plenum above, across the whole length of the hood, each compartment gets the steam it needs without robbing from adjacent compartments under the compartment dividing walls. Thus, the dewatering effect on the web, adjacent a compartment, is proportional to the amount of steam absorbed by the web at that locale which amount is controlled by the CD wall spacing in that compartment.

It will be obvious to those skilled in the art that mechanisms for adjusting CD wall positions could be utilized. Such positioners could, or course, be adjusted by a remote moisture sensing-controlling system.

Figure 4:
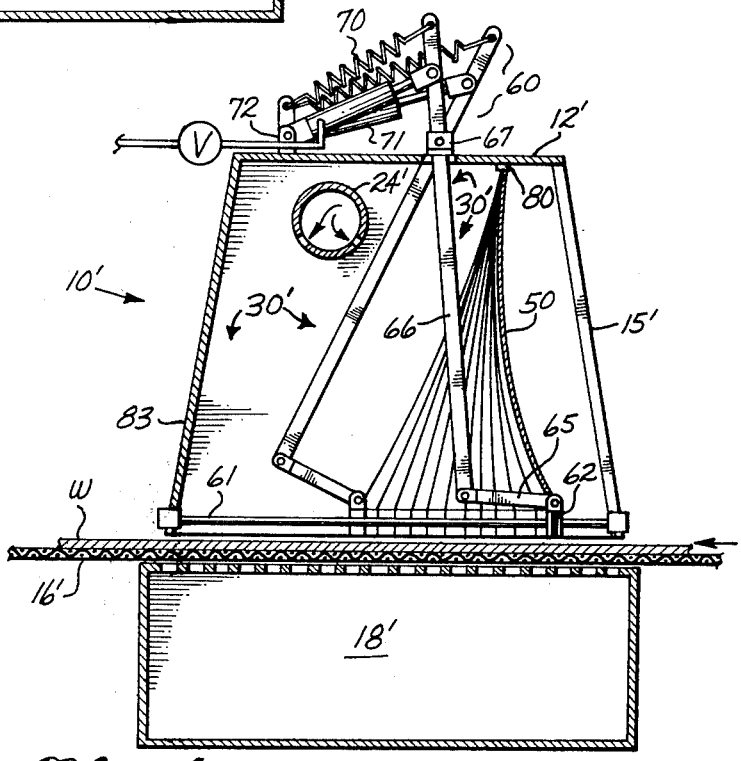
FIG. 4 is an end view of the embodiment shown in FIG. 3.
Figure 3:
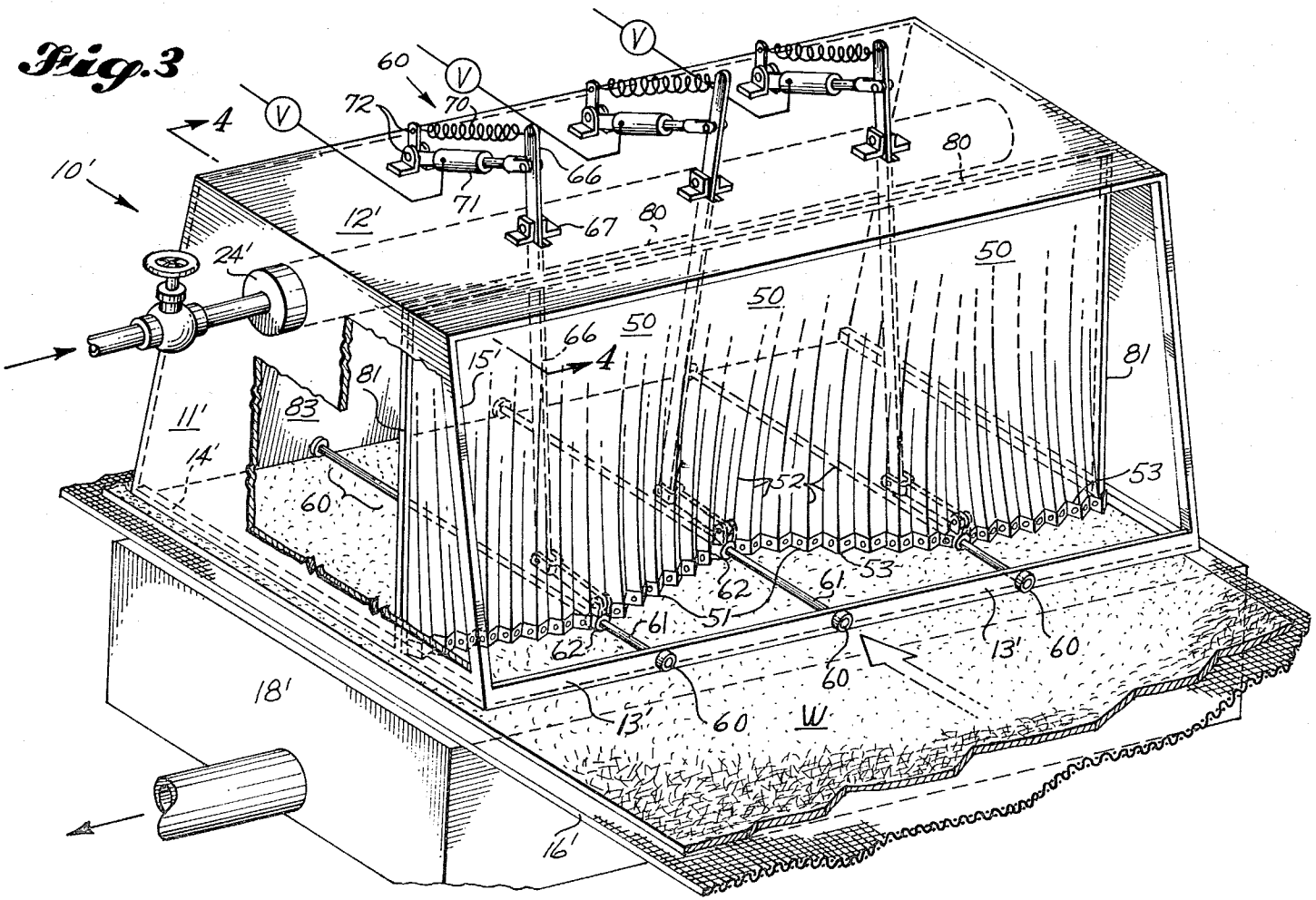
FIG. 3 is an oblique view of an embodiment having a curtain means for controlling steam discharge opening.

Another preferred embodiment of the means for incrementally adjusting the steam hood discharge area in the cross machine direction is shown in FIGS. 3 and 4. The basic hood 10 of FIGS. 1 and 2 remains the same, with respect to the hood, end walls, top and frame supporting members. The upper hood zone 30', comprising the end walls 11', top 12' and steam distributor 24' are similar to that detailed above in FIGS. 1 and 2, but without compartment dividing walls 22, 23. A solid panel forms a back wall 83 for the hood.

Referring to FIGS. 3 and 4, a flexible curtain 50 extends from hood top 12' fastening 80 to the bottom supporting members 13'. The curtain is securely fastened vertically to end wall 11' by fastening means 81, near the forward edge of the hood 10'. The curtain extends across the width of the machine. The bottom edge 51 of the curtain 50 is much wider than the CD dimension of the hood, with the excess material being arranged in pleats 52.

The bottom edge 41 of the curtain is secured to a hinge means 53 at the steam discharge level of the hood. The hinge means extends across the bottom length 13' of the hood 10'. It is dimensioned in length (cross machine dimension) so that the distances between it and the back wall 83 of the hood may be varied to control steam flow rate onto the web at the instant location. The pleats 52 of the curtain 50 expand to accommodate this adjustment.

The hood is provided with a plurality of controlling means 60 for adjusting the position of the bottom of the curtain. Each controlling means comprises a guide rod 61, extending across the width of the hood in the machine direction. The guide may be one inch diameter stainless steel pipe. A fitting 62, having an inner nylon bushing (not shown), is slidably mounted on the guiding rod 61. The fitting 62 is fastened to hinge means 53. A lever means is provided for positioning the fitting 62 on the guide rod 61, controlling the curtain position, and, hence, the steam discharge opening at a particular point. The lever means, comprising a lever arm 65 is pivotably attached to fitting 62 at one end. The opposite end of the first lever arm is pivotably attached to a second lever arm 66. The second arm 66 is pivotably supported in the pivot 67 mounted on the hood top 12'. Rotation of the second arm about the supported pivot causes horizontal adjustment of the fitting 62 and attached curtain bottom along guiding rod 61.

The controlling lever system 60 may, as shown in FIGS. 3–4, be provided with a remote adjusting capability. A spring 70 attached to a hood support 72 and second lever 66 urges the curtain 50 to remain in the fully open position, stopped by cross bracing member 13'. A hydraulic piston 71 is provided, operating between the hood-supported pivot 72 and the second lever armm 66. The piston 71, in response to a remote hydraulic pressure change, working against the tension of the spring 70 pivots lever 66, moving curtain bottom edge 51 along guide rod 61, reducing the local hood discharge opening.

Operation of the curtain hood is substantially similar to the compartmented embodiment, as described above. The bottom steam discharge opening is adjusted by changing the curtain position in response to moisture conditions measured at the reel across the width of the web, after initially selected adjustments stabilize.

The pleated curtain material must be resistant to steam temperatures and moisture. The curtain wall should be flexible enough to allow closing of the opening adjacent to a fully opened section within a CD width equivalent to wet streak widths. The curtain material may comprise a nylon sheet coated with silicon, Model 1310 manufactured by Boyd Industrial Rubber Company of Seattle, Wash. The material was 0.254 mm (0.10 in.) thick and weighed 328 g/m$^2$ (10 oz/yd$^2$). Its operating temperature is −23°–260° C. (−10°–500° F.). An asbestos cloth is also suitable.

The profiling hood is generally operated with a base line flow of steam from the hood. Since part of the objective of the hood is improved dewatering, there is always a base line flow of steam into the sheet. Also, if the temperature differences imparted by the hood are too great, the wire may distort. As a result, a sheet-disrupting ridge in the wire may develop.

Generally, having the hood discharge opening at 25 percent of the total available adjustment provides 50 percent of the total dewatering improvement due to the hood. The remaining area adjustment is available for moisture profiling.

The machine direction dimension of the discharge opening at any given point across the width of the web is adjusted by referring to the moisture profile at the reel, after conventional drying. This is a convenient measuring location and allows some correction actions to be taken for aberrations of equipment and operation that occur downstream of the steam hood location. Other locations may, of course, be used for the reference measurements.

In operation, when the machine tender discovers a wet streak or area (and has checked to ensure that the sheet basis weight profile is correct) he adjusts the discharge opening of the hood to put more steam on the wet spot. At a wet streak, the curtains, for example, would be at some greater spacing than that necessary to accomplish the normal dewatering objective of the hood.

For the compartmented embodiment, moving of only one baffle plate may be adequate to obtain streak control, if the compartmented CD dimensions are correctly selected. The box width is selected to correspond to the wet streak widths that are characteristic of a particular paper machine.

What is claimed is:

1. In a method of controlling the moisture profile to a web of paper across its width in the cross machine direction, wherein the web while being dewatered on a forming wire is blanketed with steam across the width of the web as the supported web travels over a suction box, said steam being drawn into the web condensing therein and causing the temperature of the water content of the web to increase, resulting in increased removal of condensation and slurry water by said suction box proportionate to the amount of steam absorbed by the web, and the web is subsequently dried conventionally, the improvement, comprising:

sensing the average moisture content of the conventionally dried web, at incremental widths across the entire width of said web; and adjusting the dimensions of said steam blanket in the machine direction within each incremental width, in response to the sensed moisture of that increment across the entire width of the web; and repeating the sensing and adjusting steps until a substantially uniform moisture profile across the width of the dry web results.

2. In a process for adjusting the moisture profile of a paper web across the width of a paper machine of the type wherein a steam box flows a blanket of steam onto said web as it passes over a suction box, said steam box being divided into incremental compartments across the width of the machine wherein the moisture content of a portion of the web adjacent each incremental compartment is controlled by the amount of steam flowing from each incremental compartment onto and absorbed by said web, the improvement comprising:

sensing the average moisture content of the web adjacent with respect to cross machine direction each incremental compartment; and adjusting the dimensions in the machine direction of each incremental compartment, in response to said sensing step, whereby adjusting the dimensions of the steam blanket flowing from each incremental compartment into contact with said web, as a result of the adjusting the dimensions of each compartment the amount of steam absorbed by the portion of the web adjacent each compartment changes resulting in a corresponding change in dewatering of said web portion by said suction box and ultimately a change in said moisture profile of the finished paper web.

3. An improved method for controlling the moisture profile of a paper web across its width wherein said web traveling on a paper machine is contacted with a blanket of steam extending across the width of the machine as said web passes over a suction box, the improvement, comprising:

sensing the average content of the web at incremental widths across the width of the web; and adjusting the dimensions of the steam blanket in the machine direction within each incremental width in response to the sensed moisture of that increment across the entire width of the web, as a result of the adjusting the dimensions of each compartment the amount of steam absorbed by the portion of the web adjacent each incremental width changes resulting in a corresponding change in dewatering of said web portion by said suction box, thereby controlling the ultimate moisture profile of said paper web.

* * * * *